United States Patent [19]

Hebden et al.

[11] Patent Number: 4,461,628

[45] Date of Patent: Jul. 24, 1984

[54] METHOD FOR THE GASIFICATION OF SOLID CARBONACEOUS FUEL

[75] Inventors: Dennis Hebden, Dorset, England; Charles T. Brooks, Kinross, Scotland

[73] Assignee: British Gas Corporation, London, England

[21] Appl. No.: 501,746

[22] Filed: Jun. 9, 1983

Related U.S. Application Data

[63] Continuation of Ser. No. 307,288, Sep. 30, 1981, abandoned.

[30] Foreign Application Priority Data

Jun. 9, 1981 [GB] United Kingdom ..... 8117586

[51] Int. Cl.[3] ..... C10J 3/08; C10J 3/16

[52] U.S. Cl. ..... 48/197 R; 48/206

[58] Field of Search ..... 48/197 R, 206, 203, 48/DIG. 2; 432/17, 96; 110/182.5

[56] References Cited

U.S. PATENT DOCUMENTS 3,390,971 7/1968 Hebden et al. ..... 48/197 R 3,887,326 6/1975 Townley ..... 432/17

*Primary Examiner*—Peter F. Kratz

*Attorney, Agent, or Firm*—Larson and Taylor

[57] ABSTRACT

A method of operating a gasifier having at least four, and preferably eight, tuyeres, so as to bring about a rapid turndown from full operational loading to a relatively lower operational loading without the risk of either a temporary or permanent loss of a tuyere. The gasifying medium is arranged to be supplied to the tuyeres at either a first velocity and loading or a second, lower, velocity and loading and in carrying out the method the gasifying medium supplied to some or all of the tuyeres is changed abruptly from the first to the second velocity and loading at selected frequent intervals, in a predetermined pattern, so that a selective pulsing operation of the tuyeres occurs to bring about the required reduction in loading.

4 Claims, 6 Drawing Figures

FIG.1.
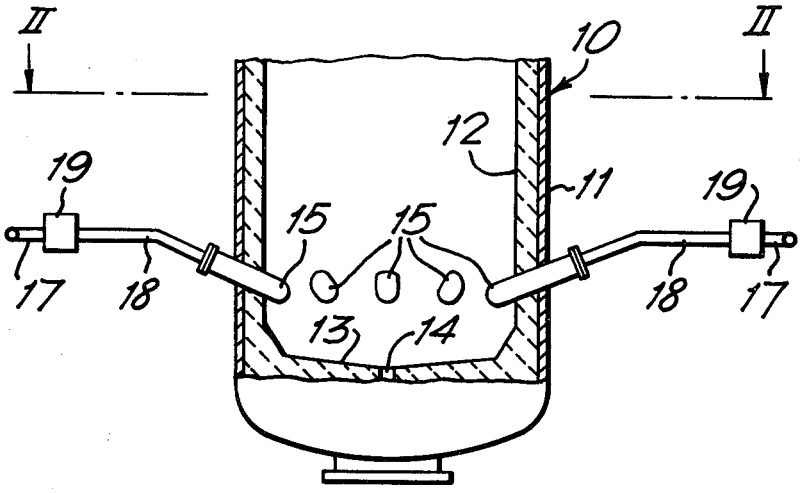
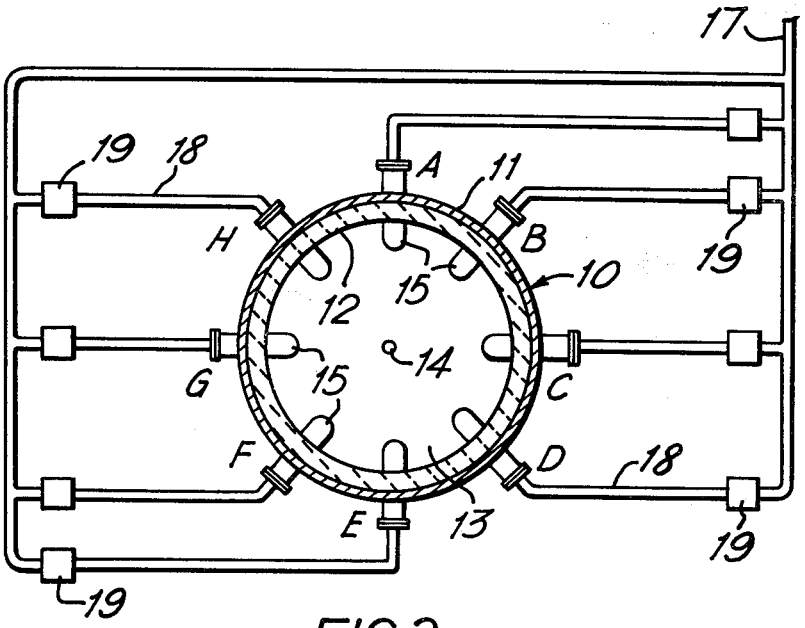
FIG.2.

FIG.3.
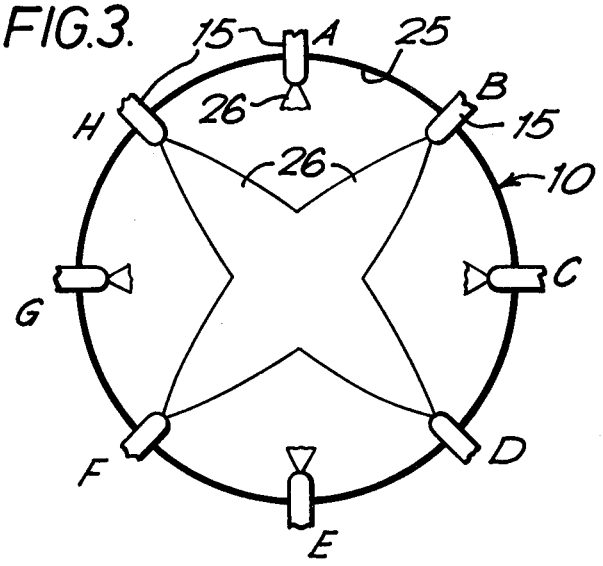
FIG.4.
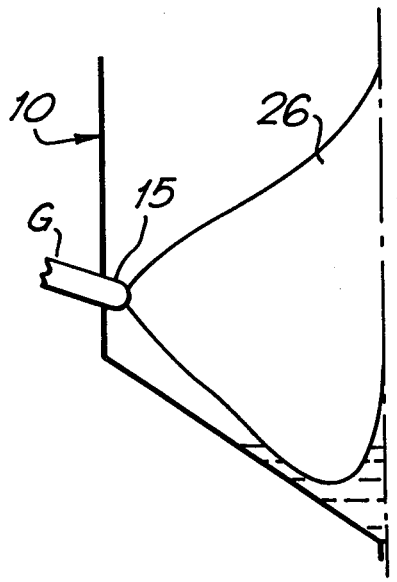
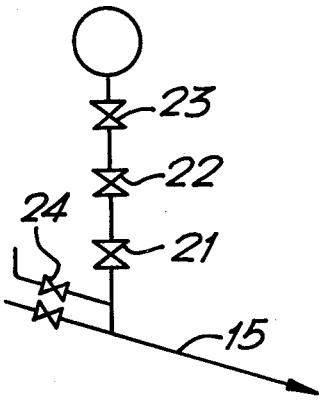
FIG.5.

METHOD FOR THE GASIFICATION OF SOLID CARBONACEOUS FUEL

This application is a continuation of application Ser. No. 307,288 filed Sept. 30, 1981, now abandoned.

This invention relates to a method of and apparatus for the gasification of solid carbonaceous fuel and has an important application of the gasification of fuel such as coal or coke under super atmospheric pressures.

Apparatus of this kind usually comprises a column-like vessel containing the solid carbonaceous fuel into the lower part of which is introduced a gasifying medium through a plurality of tuyeres disposed around the lower part of the vessel. The gasification is carried out at a high temperature so that the ash which collects beneath the fuel bed is in liquid form, and can be continuously discharged from the lower part of the vessel, fresh fuel being supplied continuously to the bed.

Preferably the tuyeres are water cooled and project a short distance into the fuel bed from the wall of the vessel which is usually formed of refractory material and may also be water cooled. During gasification it is sometimes necessary to reduce the operational loading of the gasifier either in a controlled manner during normal operation or relatively quickly in an emergency. Hitherto such reduction in operational loading has been achieved by turning off completely one or more of the tuyeres and this entails the disadvantage that backflow can occur at the tuyere nozzle and may result in slag blockage and the permanent loss of the tuyere. Even if the loss of the tuyere does not occur it may be difficult to restart the tuyere when the gasifier is to be returned to full operational loading.

An object of this invention is to provide a method of gasification of solid carbonaceous fuel which to some extent alleviates the above-mentioned disadvantage.

According to one aspect of the invention there is provided a method of operating a gasifier having a column-like vessel in which a bed of ash-containing solid carbonaceous fuel is gasified by introducing a gasifying medium into a lower part of the fuel bed from m tuyeres disposed around the lower part of an inner wall of the vessel, m being an integer greater than 3, the gasification being carried out at a high temperature such that the ash collects in liquid form beneath the fuel bed, and in which the gasifying medium can be caused to issue from the tuyeres either at a first velocity and loading such that good gasification and good conditions in front of the tuyeres are obtained or at a second reduced velocity and loading such that satisfactory gasification and conditions in front of the tuyeres are obtained, wherein the gasifying medium is periodically caused to issue from n of the tuyeres at the first velocity and loading, n being an integer less than m, the gasifying medium being caused to issue from the remaining tuyere or tuyeres at the second velocity and loading, the velocity and loading of the gasifying medium issuing from all the m tuyeres being changed abruptly in a predetermined pattern such that each tuyere is supplied with gasifying medium at the second velocity and loading at selected frequent intervals and at the first velocity and loading at all other times, whereby a selective pulsing operation of the tuyeres occurs such as to bring about a rapid turndown from full continuous operational loading of the gasifier to a relatively lower continuous operational loading thereof.

The tuyere loading is the amount of gasifying medium, usually of steam and oxygen, which can be expressed in standard cubic feet per hour and which flows down a particular tuyere from the steam/oxygen manifold and the velocity of the gasifying medium is that measured at a tuyere tip or nozzle of a certain diameter under prescribed conditions of pressure and temperature.

All values of m−n down to 1 can be used and the preferred predetermined pattern is such that high velocity and high loading tuyeres are arranged symmetrically around the fuel bed and such that the time during which any tuyere is at a low velocity and low loading is reduced to a minimum.

Conveniently, the predetermined pattern is such that the gasifying medium at the second velocity and loading is supplied to one or more tuyeres at a time, and gasifying medium at the second velocity and loading is preferably not supplied to an adjacent tuyere until after it has been supplied to an immediately non-adjacent tuyere and so on.

Suitably the first velocity does not exceed one thousand feet per second and the second velocity is not below one hundred feet per second.

In one embodiment of the invention the first velocity is within the range three hundred to seven hundred feet per second and the second velocity is within the range one hundred feet to three hundred feet per second.

According to another aspect of the invention apparatus for carrying out the method defined above comprises a column-like refractory vessel, m tuyeres disposed around the lower part of an inner wall of the vessel for introducing gasifying medium into the fuel bed, m being an integer greater than 3, a valve arrangement for each tuyere operable so that the gasifying medium can issue from the tuyere either at a first velocity and loading such that gasification extends to a central region of the fuel bed or at a second reduced velocity and loading such that gasification occurs only at an outer region of the fuel bed close to the wall of the vessel, and means for controlling the operation of the valve arrangements to change the velocity and loading of the gasifying medium issuing from the tuyeres abruptly between the first and second velocities and loadings in a predetermined pattern such that each tuyere is supplied with gasifying medium at the second velocity and loading at selected frequent intervals and at the first velocity at all other times, whereby a selective pulsing operation of the tuyeres occurs such as to bring about a rapid turndown from full continuous operational loading of the gasifier to a relatively lower continuous operational loading thereof.

Preferably the means for controlling the valve arrangement is arranged to periodically cause the gasifying medium to issue from n of the tuyeres at the second velocity and loading, n being an integer less than m. Typically, m may equal 8 and m−n equal 4.

An embodiment of the invention will now be described, by way of example, with reference to the accompanying drawings in which:

FIG. 1 is a vertical cross section of the lower part of the gasification apparatus in accordance with the invention;

FIG. 2 is a horizontal cross section of the apparatus shown in FIG. 1, taken on the line II—II in that Figure;

FIG. 3 is a diagrammatic horizontal section of the raceways taken through the plane of the tuyere tips;

FIG. 4 is diagrammatic vertical cross-section of a raceway taken through the plane of a tuyere tip;

FIG. 5 is a schematic diagram of the valves controlling the supply of the gasifying medium to a tuyere.

Figure 6:
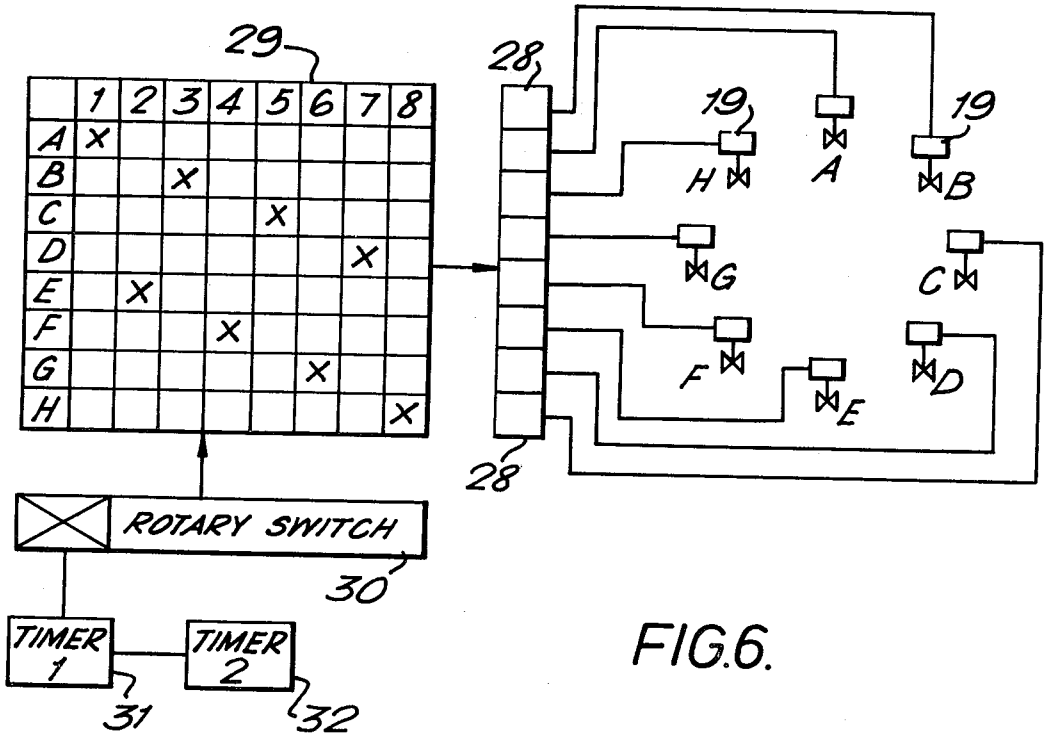
FIG. 6 is a schematic diagram illustrating the order of operation of the eight control valves of the gasifier illustrated in FIGS. 1 and 2.

Referring in the first instance to FIGS. 1 and 2, the gasifier comprises a vertically disposed column-like vessel 10 having a cylindrical casing 11 of refractory metal surrounding a layer 12 of refractory material. The vessel 10 has a hearth 13 provided with a central outlet 14 through which liquid ash can be discharged from the vessel. Eight tuyeres 15 located at the lower part of the vessel 10 just above the hearth 13 extend radially inwards into the interior of the vessel at circumferentially spaced positions indicated by the letters A to H. The tuyeres 15 are inclined downwards at an angle to the horizontal of approximately 20°.

The eight tuyeres 15 are supplied with a gasifying medium, typically steam and oxygen, from a supply pipe 17 by way of inlet pipes 18 and individual control valve arrangements 19. As indicated in FIG. 5 each control valve arrangement 19 comprises a manually adjustable control valve 21 for adjusting the maximum flow of gasifying medium to a tuyere 15, an automatic "slam shut" valve 22 for shutting off the supply of gasifying medium in an emergency and a butterfly valve 23 for controlling the supply of gasifying medium in accordance with the method of the invention. Air is also supplied to each tuyere by way of a further control valve 24.

The butterfly valves 23 are arranged to be adjustable abruptly and automatically between a position in which the velocity of the gasifying medium is at or about an upper limit and with gasification in front of the tuyeres is good as indicated at positions B, D, F and H in FIGS. 3 and 4 and a position in which the velocity of the gasifying medium is at or about a lower limit as indicated at position A, C, E and G in FIG. 3 and gasification is satisfactory and the function of being able to return rapidly to the velocity indicated at positions B, D, F and H is retained.

The so-called raceway 26 in the fuel bed formed by the gasifying medium can therefore change abruptly from the relatively large volume indicated at each of the positions B D, F and H to the much reduced volume indicated at each of the positions A, C, E and G. Typically, the volume of the raceway 26 as indicated at each of the positions A, C, E and G would amount to less than 10% of the volume indicated at each of the positions B, D, F and H.

As shown in FIG. 6 each of the control valve arrangements 19 associated with positions A to H is arranged to be actuated by a solenoid-operated valve 28 to change the butterfly valves 23 abruptly from one operated-position to the other. The eight solenoid operated valves are controlled by a programming matrix 29 which is in turn controlled by a rotary sequencing switch 30, for example a uniselector. The rotary sequencing switch 30 is arranged to be stepped by two timers 31 and 32 connected in a bistable mode. The timers 31 and 32 are of a kind which are adjustable to provide timing periods between 0.1 and 999.9 minutes and can be set to give eight periods of the same length or alternate periods of longer and shorter duration. The sequence of operation of the solenoid-operated valves is indicated by the symbols "X" shown in the drawing.

The method of operating the gasification apparatus in accordance with the invention is as follows. Solid carbonaceous fuel such as coal or coke is supplied to the upper part of the vessel 10 so that it moves downwards towards the hearth 13. The velocity and loading of the gasifying medium issuing from the tuyeres 15 at all the positions A to H is maintained at the upper velocity so that the gasification apparatus is operating at substantially its full operational loading.

When the operational loading of the gasification apparatus is required to be reduced the velocity and loading of the gasifying medium issuing from a particular tuyere 15 is reduced abruptly to the lower velocity and loading so that the volume of the raceway 26 is reduced to that indicated at position A. The velocity and loading of the gasification medium issuing from all the tuyeres 15 is reduced abruptly in turn, in a predetermined cyclically repeating pattern such that each tuyere 15 is supplied with gasifying medium at the lower velocity at selected frequent intervals and at the higher velocity and loading at all other times. Selective pulsing operation of the tuyeres 15 in this way brings about a rapid turndown from full operational loading to a relatively lower operational loading, and the amount of the reduction in the operational loading will depend on the number of the tuyeres 15 which are operating at the reduced velocity loading and loading and the period of time for which such reduced velocity loading is maintained.

Typically the upper velocity of the gasifying medium is not more than one thousand feet per second and the lower velocity is not less than one hundred feet per second. Preferably the upper velocity is within the range three hundred to seven hundred feet per second, and the lower velocity is within the range one hundred to three hundred feet per second. In this way the loading of the gasification apparatus may be reduced to 25% of the full operational loading. As indicated in FIG. 6 the predetermined cyclically repeating pattern is that indicated by the symbols "X" in that Figure. If both of the timers 31 and 32 are set to the same period then the sequence of operations would be as indicated in Table 1 below.

TABLE I

| Period | Tuyeres at low velocity and loading | Tuyeres at high velocity and loading |
|---|---|---|
| 1 | Position A | Position B to H |
| 2 | Position E | Positions A to D and F to H |
| 3 | Position B | Positions A and C to H |
| 4 | Position F | Positions A to E, G and H |
| 5 | Position C | Positions A, B and D to H |
| 6 | Position G | Positions A to F and H |
| 7 | Position D | Positions A to C and E to H |
| 8 | Position H | Positions A to G |

Typically the periods of the two timers would be substantially three minutes so that the cyclically repeating pattern would be such that each tuyere 15 would be at the lower velocity for three minutes, the remaining tuyeres 15 being at the higher velocity during this time. Inspection of the cyclically repeating pattern shown in FIG. 6 will show that the two tuyeres 15 at adjacent positions are not supplied with gas at the lower velocity consecutively.

While in the cyclically repeating pattern shown in FIG. 6 only one of the eight tuyeres 15 is supplied with gasifying medium at the lower velocity at any one time the invention can be applied to m tuyers where m is an integer greater than 3 of which n tuyeres, where n is an integer less than m, are supplied with gasifying medium at the lower velocity at any one time. For example when there are eight tuyeres 15 as described above n could equal 2 and two of the tuyeres could be supplied with gasifying medium at the lower velocity concurrently, the remainder of the tuyeres being supplied with gasifying medium at the higher velocity and the pattern being changed abruptly at frequent intervals.

In another preferred apparatus, in which there are eight tuyeres 15, the predetermined pattern may be such that four tuyeres are supplied with the gasifying medium at the higher velocity concurrently and four tuyeres are supplied with the gasifying medium at the lower velocity, the pattern being changed abruptly at frequent intervals. The predetermined pattern may be such that alternate tuyeres around the fuel bed are at the higher velocity and the remaining four tuyeres are at the lower velocity, the pattern being changed abruptly, at frequent intervals, so that the higher velocity tuyeres become lower velocity tuyeres, and vice versa.

The cyclically repeating pattern may be modified so that a varying number of the tuyeres 15 are supplied with gasifying medium at the higher velocity at any one time for example the cyclically repeating pattern could be as shown in Table II.

TABLE II

| Period | Tuyeres at low velocity and loading | Tuyeres at high velocity and loading |
|---|---|---|
| 1 | Position A | Positions B to H |
| 2 | | Positions A to H |
| 3 | Position B | Positions A and C to H |
| 4 | | Positions A to H |
| 5 | Position C | Position A, B and D to H |
| 6 | | Position A to H |
| 7 | Position D | Positions A to C and E to H |
| 8 | | Positions A to H |
| 9 | Position E | Position A to D and F to H |
| 10 | | Positions A to H |
| 11 | Position F | Positions A to E, G and H |
| 12 | | Positions A to H |
| 13 | Position G | Positions A to F and H |
| 14 | | Positions A to H |
| 15 | Position H | Positions A to G |
| 16 | | Positions A to H |

Typically with this cylically repeating pattern each of the periods 1 to 16 would have a duration of three minutes and the timers 31 and 32 would be set accordingly.

This modification of the cylically repeating pattern has the advantage that the overall volume of the raceways 26 changes with time. In the previously described cyclically repeating pattern illustrated in FIGS. 3 and 4 it is only the overall shape of the pattern of the raceway which changes. The total volume of the raceways 26 remains substantially the same at all times. Thus the volume would be:

$$\text{Volume (eight tuyeres)} = 8.A\,\frac{(\text{total load})^2}{8}$$

$$\text{Volume (seven tuyers)} = 7.A\,\frac{(\text{total load})^2}{7}$$

The ratio V8/V7 is thus $\frac{7}{8}$ and the total volume of the raceway 26 will change from the odd numbered periods to the even numbers periods. This is a more severe form of the pulsing of the tuyeres and has the disadvantage that flow control of the gasifying medium might tend to be unstable as the pressure drop across the system varies.

If the minimum tuyere penetration is independent of the total number of tuyeres, then the minimum gasifier loading will be 16,000. z SCF/H oxygen where z is the number of tuyeres supplied with gasifying medium at the higher velocity. In practice, some three dimensional symmetry has to be preserved in loading the tuyeres, so in a static condition the lowest possible loading is $4\times16{,}000.00=64{,}000.00$ SCF/H oxygen with four tuyeres. If four tuyeres are pulsed in the m-1 or m-2 mode then a kind of symmetry will be preserved, with loadings of 48,000. or 32,000. SCF/H oxygen. Many other modifications of the cyclically repeating pattern are possible and can readily be derived to obtain the overall objective of reducing the operational loading of the gasifier to a relatively lower value.

Moreover, the selective pulsing of the tuyere in this way assists the continous and smooth movement of the fuel down the bed of the gasifying apparatus and there is a reduced tendency for the fuel to hang above the tuyeres and form a bridge which extends outwards from the interior wall of the vessel.

We claim:

1. A method of operating a gasifier having a column-like vessel in which a bed of ash-containing solid carbonaceous fuel is gasified by introducing a gasifying medium into a lower part of the fuel bed from m tuyeres disposed around the lower part of an inner wall of the vessel, m being an integer greater than 3, the gasification being carried out at a high temperature such that the ash collects in liquid form beneath the fuel bed, and in which the gasifying medium is caused to issue from the tuyeres either at a first velocity within the range three hundred to seven hundred feet per second and loading such that gasification extends to a central region of the fuel bed or at a second reduced velocity within the range one hundred to three hundred feet per second and loading such that gasification occurs only at an outer region of the fuel bed, said method further comprising providing a first, full operational loading mode wherein all of said m tuyeres are operated at the first velocity and loading and providing turndown from said full operational loading mode to a second, relatively lower operational loading mode by initiating a pulsing operation of the tuyeres wherein the gasifying medium is periodically caused to issue from n of the tuyeres at the second velocity and loading, n being an integer less than m, the gasifying medium being caused to issue from the remaining tuyere or tuyeres at the first velocity and loading, the velocity and loading of the gasifying medium issuing from all the m tuyeres being changed abruptly in a predetermined pattern such that each tuyere is supplied with gasifying medium at the second velocity and loading at selected frequent intervals and at the first velocity and loading at all other times.

2. A method as claimed in claim 1, wherein m−n is more than 1 and the predetermined pattern is such that tuyeres caused to issue the gasifying medium at the first velocity and loading are arranged symmetrically around the fuel bed.

3. A method as claimed in claim 1, wherein m equals 8.

4. A method according to claim 1, wherein there are at least four tuyeres arranged in a generally circular arrangement wherein pairs of tuyeres are located substantially opposite one another, and said predetermined pattern is such that gasifying medium at the second velocity and loading is supplied to a first tuyere, then gasifying medium at the second velocity and loading is supplied to the tuyere opposite said first tuyere, thereafter gasifying medium at said second velocity and loading is supplied to the next adjacent tuyere to said first tuyere, and thereafter gasifying medium at the second velocity and loading is supplied to the tuyere opposite to said next adjacent tuyere and so on, said predetermined pattern being repeated.

* * * * *